United States Patent [19]

Kawaura

[11] 4,236,279

[45] Dec. 2, 1980

[54] PLANETARY COILER

[75] Inventor: Kouichi Kawaura, Kariya, Japan

[73] Assignee: Kabushiki Kaisha Toyoda Jidoshokki Seisakusho, Aichi, Japan

[21] Appl. No.: 971,500

[22] Filed: Dec. 20, 1978

[30] Foreign Application Priority Data

Dec. 28, 1977 [JP] Japan ..... 52/159591
Jan. 6, 1978 [JP] Japan ..... 53/000776

[51] Int. Cl.[3] ..... B65H 54/80
[52] U.S. Cl. ..... 19/159 R
[58] Field of Search ..... 19/159 R, 159 A; 100/82; 68/177

[56] References Cited

U.S. PATENT DOCUMENTS 3,938,222 2/1979 Garrison ..... 19/159 R

FOREIGN PATENT DOCUMENTS 51-72624 6/1976 Japan .

*Primary Examiner*—Louis Rimrodt
*Attorney, Agent, or Firm*—Burgess, Ryan and Wayne

[57] ABSTRACT

A planetary coiler for depositing a sliver in a stationary can comprising a rotary disc mounted on a stationary frame by way of a thrust bearing, a sliding supporting member slidably mounted on the inner side of the rotary disc, a coiler plate mounted on the supporting member, a calender roller mounted on the supporting member, and a turn plate provided with a sliver guide tube rotatably supported on the rotary disc, wherein any gap other than a small contact gap with the turn plate is not present so as to substantially prevent catching of sliver on the gap or intrusion of fibers into the gap. An annular gear is rotatably supported on the top surface of the rotary disc and centering of the annular gear is performed by the inner circumferential face of the rotary disc or the peripheral face of the annular gear.

6 Claims, 8 Drawing Figures

PLANETARY COILER

BACKGROUND OF THE INVENTION (1) Field of the Invention

The present invention relates to a planetary coiler for depositing a sliver in a stationary can.

(2) Description of the Prior Art

In a conventional planetary coiler, a rotary disc rotatable with respect to a stationary frame is disposed concentrically with a stationary can located below and a turn plate is disposed eccentrically with this rotary disc so that the turn plate is received by the rotary disc. Accordingly, the turn plate revolves round the can while turning on its axis, and sliver delivered through a sliver guide tube attached to the turn plate is deposited in the can while being coiled.

Recently, sizes of cans have been increased to hold large quantities of sliver. Large cans are difficult to rotate so the demand for planetary coilers is increasing while conventional relatively small cans are still used. Accordingly, in designing spinning machines (such as carding and combing machines), it is necessary to adopt a planetary coiler capable of easily changing the diameter of coiling according to the size of a can to be used and also the thickness of depositing sliver in a large can. This change or adjustment of the diameter of coiling is necessary not only when the can diameter is changed but also in order to cope with the change in the apparent thickness of sliver caused by changes of spinning conditions such as the degree of condensing the thickness of the sliver, the grain number (that is, thickness of sliver) and the kind of material fibers, in order to deposit large quantities of sliver precisely in cans.

As means developed to meet the above mentioned need, U.S. Pat. No. 3,345,701 proposed an apparatus in which the eccentric position of the turn plate with respect to the rotary disc (concentric with a can) can be adjusted. The structure of the apparatus disclosed in this patent is very complex and is difficult to operate at high speed. Further, the adjustment of the eccentric position of the turn plate in the apparatus disclosed in U.S. Pat. No. 3,345,701 is very troublesome, and this apparatus has a fatal defect in that it is substantially impossible to provide for adjustment of the can diameter over a broad range (910 to 1020 mm).

As means for eliminating the drawbacks involved in the conventional apparatus, there has been proposed an apparatus in which a slide plate (coiler plate) is attached to a rotary disc (wheel) so that linear movement of the slide plate for adjustment is possible, a turn plate is mounted on this slide plate, a supporting member of a calender roller is attached to the slide plate, and rotation is transmitted to the turn plate and calender roll through an internal gear attached concentrically to the rotary disc, to which rotation is transmitted from a stationary drive source (see Japanese patent application Laid-Open Specification No. 72624/76). In this apparatus, since a contact line is formed between the rotary disc and slide plate, it is possible for a sliver to be caught by this contact line, so that fibers intrude into contact gaps formed along the contact line. Accordingly, the coiling operation cannot be carried out in good condition. Further, because of the presence of the rotary disc, the diameter of the stationary frame must be increased, causing the structure of the machine to be complex and the size to be increased.

Still further, in this apparatus, since an upper rotary disc for supporting the rotary disc on the stationary frame is supported on the top face of the stationary frame by a vertical roller, and heavy a coiler plate and turn plate, and the like, are supported on this upper rotary disc, the load imposed on the vertical roller is quite large and a compressive force is inevitably applied to the entire mechanism. Accordingly, the apparatus makes it impossible to perform the spinning operation stably.

Moreover, in this device, since an annular gear is supported on the top face of the stationary frame by the vertical roller and centering is performed by a horizontal roller, there is a defect in that centering of the annular gear with respect to the rotary disc cannot be performed precisely.

SUMMARY OF THE INVENTION

It is a primary object of the present invention to provide a planetary coiler for a spinning machine, such as a carding and combing machine in which the above-mentioned three defects involved in the conventional device are eliminated.

In accordance with the present invention, there is provided a planetary coiler comprising a rotary disc mounted on a stationary frame, a sliding supporting member slidably mounted on the inner side of the rotary disc, a coiler plate mounted on the supporting member, a calender roller mounted on the supporting member, and a turn plate provided with a sliver guide tube rotatably supported on the rotary disc, wherein any gap other than a small contact gap with the turn plate is not present so as to substantially prevent the catching of sliver on the gap or intrusion of fibers into the gap, and accordingly coiling of the sliver can be performed in very good condition, and further, the structure of the device is simplified and made compact.

In the device of the present invention, the above-mentioned second and third problems are solved by adoption of the structure in which the rotary disc is mounted on the stationary frame by way of a thrust bearing, an annular gear is rotatably supported on the top surface of the rotary disc and centering of the annular gear is performed by the inner circumferential face of the rotary disc or the peripheral face of the annular gear, whereby the coiler plate and turn plate can be stably supported on the rotary disc, centering of the annular gear with the rotary disc can be performed precisely and the machine provided with the apparatus according to the present invention can be operated very stably.

DETAILED DESCRIPTION OF THE PREFERRED EMBODIMENTS

The structure, function and effect of the planetary coiler of the present invention will now be described in detail by reference to an embodiment illustrated in FIGS. 1 to 8.

Figure 1:
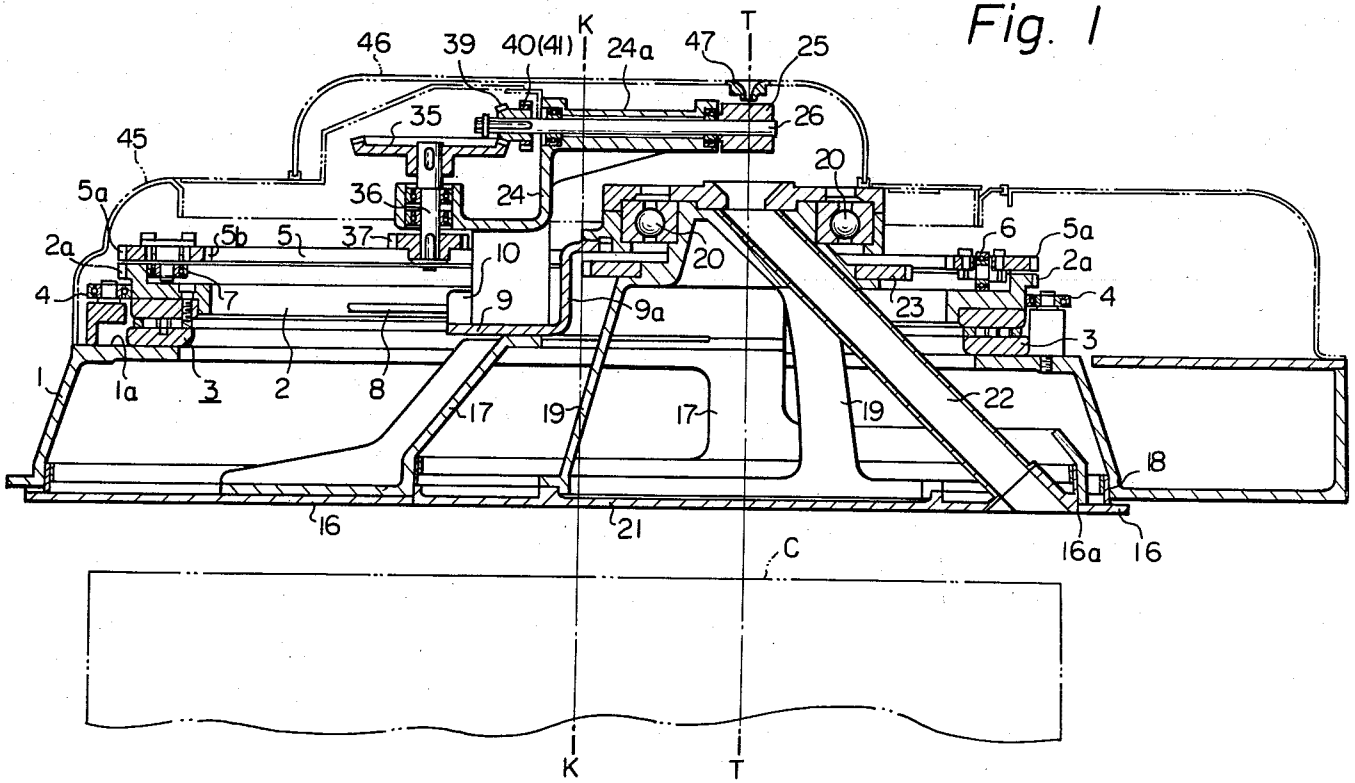
FIG. 1 is a sectional view illustrating one embodiment of the device according to the present invention.
Figure 2:
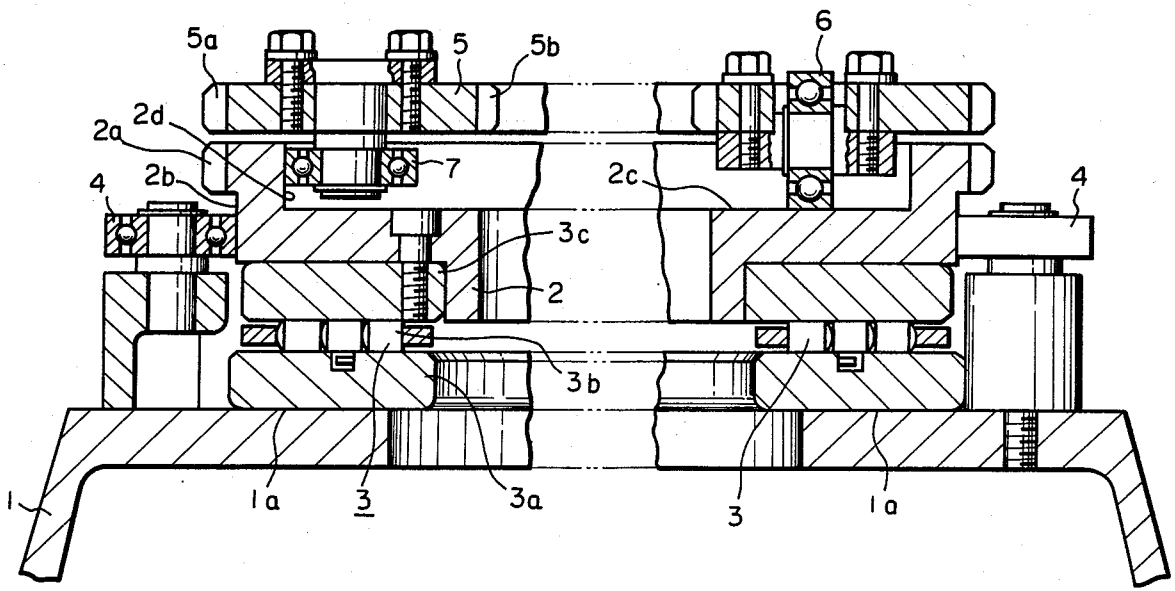
FIG. 2 is an enlarged sectional view illustrating the mounting condition of the rotary disc and annular gear in the device illustrated in FIG. 1.
Figure 3:
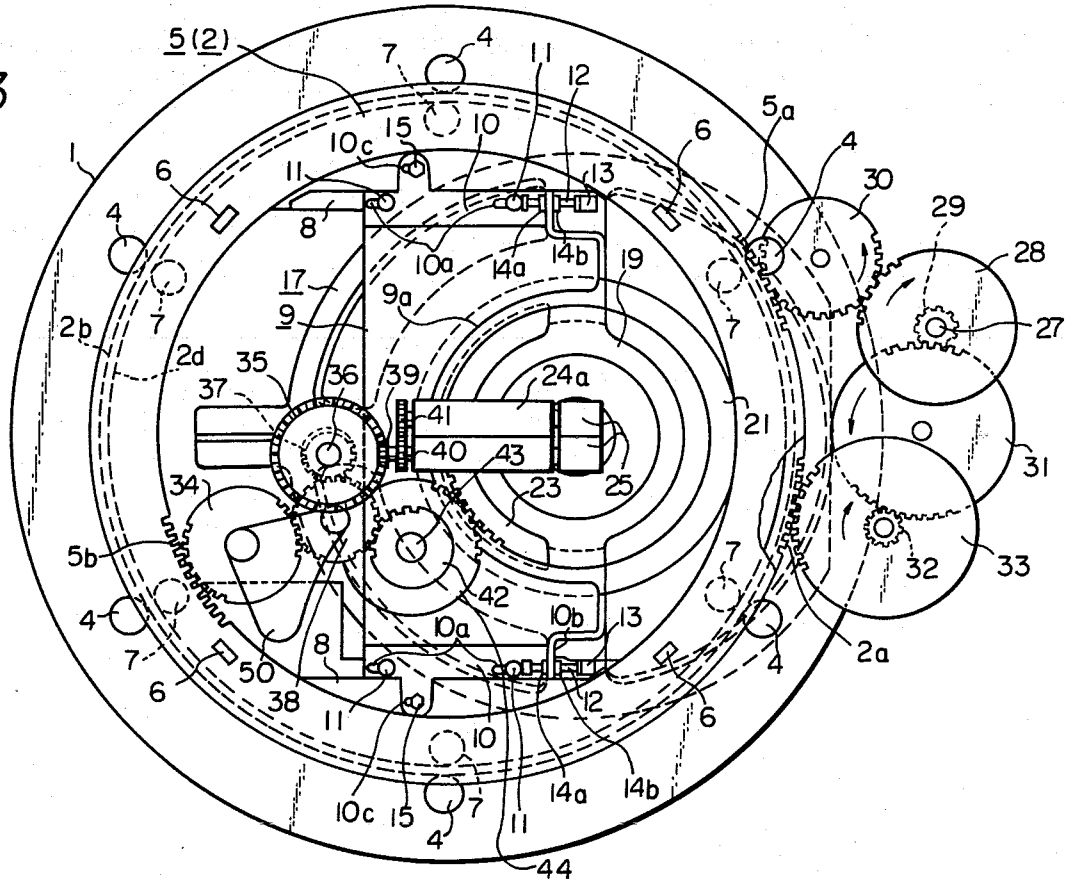
FIG. 3 is a plan view of the device illustrated in FIG. 1.

Referring to FIGS. 1 to 8, a rotary disc 2 is supported on the top face 1*a* of a stationary frame 1 by way of a bearing means 3, as illustrated in FIG. 2, so that the disc 2 is capable of rotating in a horizontal plane. A gear 2*a* is formed on the periphery of a top portion of the disc 2, and a plurality of horizontal rollers 4 (6 in the present embodiment as illustrated in FIG. 3) disposed on the top surface 1*a* of the stationary frame 1 are allowed to rotate on the peripheral face 2*b* of the disc 2 while in contact therewith, so that the center K—K of rotation of the rotary disc 2 is fixed.

The bearing means 3 comprises a supporting ring 3*a* mounted on the top face 1*a* of the stationary frame 1, a thrust bearing 3*b* mounted on the supporting ring 3*a* and a supported ring 3*c* supported on the thrust bearing 3*b* and fixed to the lower face of the rotary disc 2. This bearing means 3 does not have a function of regulating the rotation center K—K of the rotary disc 2.

As annular gear 5 is supported on the top face 2 C of the inside of the rotary disc 2 by a plurality (4 in the present embodiment as illustrated in FIG. 3) of vertical rollers 6, so that the gear 5 is capable of rotating in a horizontal plane. The annular gear 5 has outer teeth 5*a* the inner teeth 5*b*, and is arranged so that when a plurality (6 in the present embodiment as illustrated in FIG. 3) of horizontal rollers 7 hanging down from the lower face of the annular gear 5 are caused to rotate while in contact with the inner circumferential face 2*d* of the upper portion of the rotary disc 2, the center of the rotation of the annular gear 5 is caused to be in agreement with the rotation center K—K of the rotary disc 2.

Figure 4:
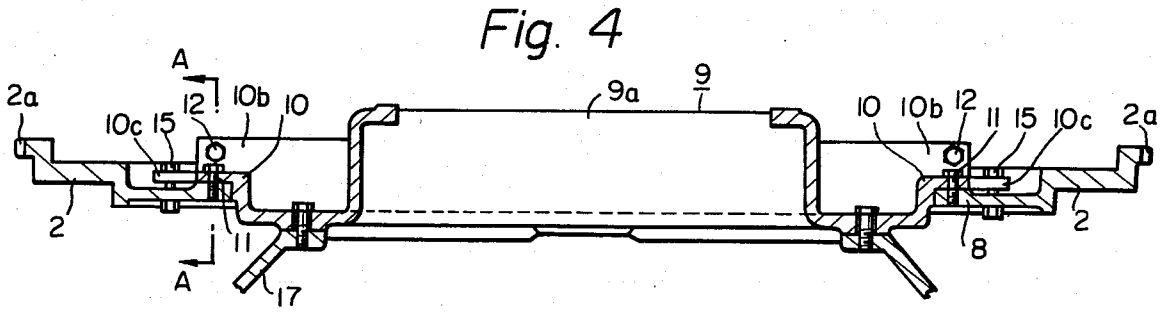
FIG. 4 is an enlarged view illustrating the mounting of the sliding supporting member in the device illustrated in FIG. 1.
Figure 5:
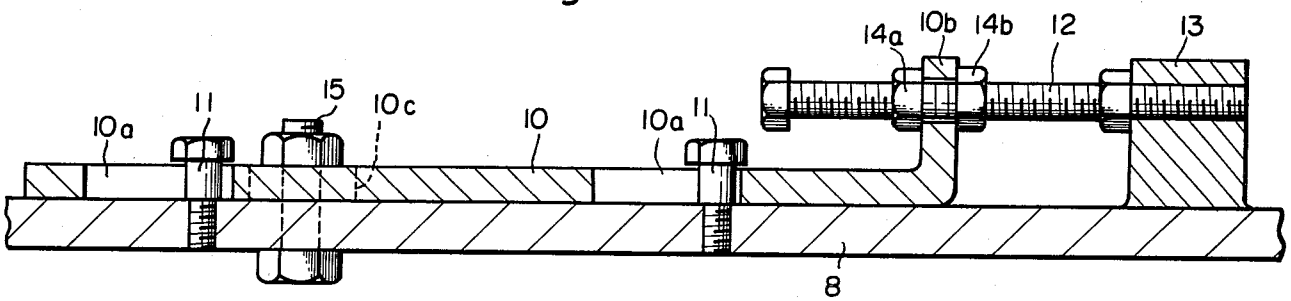
FIG. 5 is a view illustrating the section taken along the line A—A in FIG. 4.

As illustrated in FIGS. 3 and 4, a pair of parallel supporting members 8, which are integrally molded at a position inside of the rotary disc 2, and a sliding supporting member 9 is slidably held by the supporting member 8 by way of a pair of left and right attachment vanes 10 thereof, respectively. As illustrated in FIG. 5, two long apertures 10*a* are formed through the attachment vanes 10, respectively, and a guide pin 11 fixed to the side of the supporting member 8 is loosely inserted in each long aperture 10*a*. An adjust bolt 12 is screwed into a supporting block 13 fixed to the top face of the end portion of the supporting member 8 and a vertical portion 10*b* formed by upwardly bending one of the vane 10 is loosely inserted through the adjust bolt 12 and is clamped and fixed by nuts 14*a* and 14*b* from both the sides thereof. In this arrangement, when one nut 14*b* is loosened and the other nut 14*a* is turned, the vertical portion lob of the attachment vane 10 is moved to the right side in FIG. 5, so that the sliding supporting member 9 moves as a whole along the supporting member 8. A bolt 15 is inserted through a projection 10*c* formed to pierce through the supporting member 8 from the lower face to the top face of the supporting member 8 on one side of the attachment vane 10, and the sliding supporting member 9 is secured to the supporting member 8 through this bolt 15.

Figure 6:
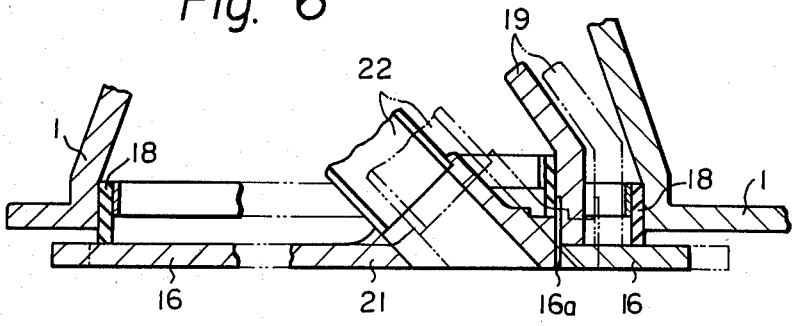
FIG. 6 is a partially cut-out, enlarged sectional view illustrating the coiler plate and turn plate in the device illustrated in FIG. 1.
Figure 7:
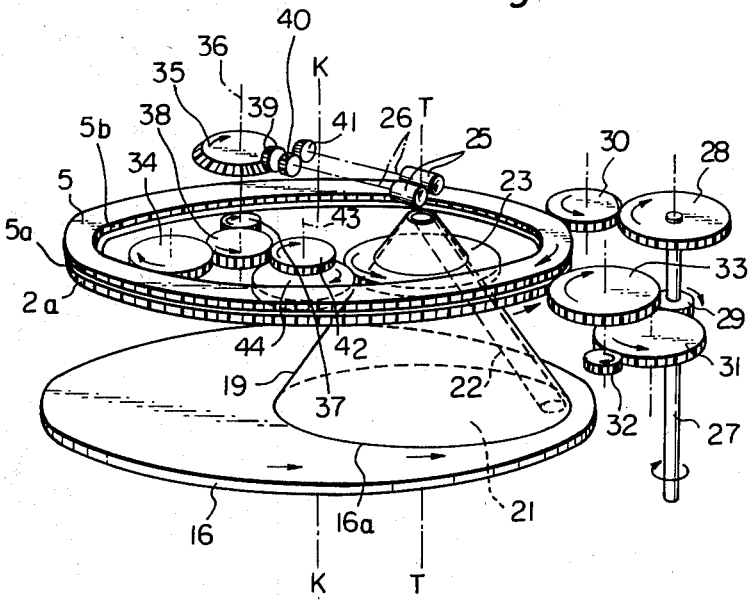
FIG. 7 is a perspective view illustrating the power transmission mechanism used for the device illustrated in FIG. 1.

As illustrated in FIG. 1, a coiler plate 16 is fixed to the lower surface of the sliding supporting member 9 through a connecting member 17 at a position slightly lower than the position of the lower edge of the stationary frame 1. An aperture 16*a* for the fitting therein of a turn plate 21, described hereinafter, is formed at an eccentric position of the coiler plate 16. As illustrated in FIG. 6, a rail member 18 is fitted to the inner circumferential face of the lower end of the stationary frame 1 so that the lower edge of the rail member 18 falls in contact with the top face of the outside of the coiler plate 16.

As illustrated in FIG. 1, a connecting member 19 is supported through a bearing 20 on an attachment cylinder 9*a* (see FIG. 4), having an upwardly extending semi-cylindrical shape and being integrally formed on the central portion of the sliding supporting member 9, so that the connecting member 19 is capable of rotating in a horizontal plane. A turn plate 21 is fixed to the lower end of the connecting member 19 and is fitted in the aperture 16*a* of the coiler plate 16 in a non-contact condition, and this turn plate 21 is arranged so that it is capable of rotating about the rotation axis T—T eccentric to the above-mentioned rotation axis K—K. A sliver guide tube 22 is disposed to extend inclined from the center of the top end of the connecting member 19, namely the position of the rotation axis T—T of the turn plate 21, to the peripheral portion of the turn plate 21, and a gear 23 for rotation of the turn plate 21 is fitted on the periphery of the upper portion of the connecting member 19.

As illustrated in FIG. 1, a supporting bracket 24 is vertically disposed on the top surface of the sliding supporting member 9, and a pair of calender rollers 25 are fixed to shafts 26 turnably mounted on a pair of bearings 24*a*, formed integrally on the upper portion of the bracket 24, so that sliver can be fed into an upper opening of the sliver guide tube 22.

By rotating the rotary disc 2 and annular gear 5, the sliding supporting member 9 and coiler plate 16 are rotated with the rotation axis K—K as the center of rotation and the turn plate 21 is caused to revolve round the axis K—K, and by rotating the annular gear 5, the turn plate 21 is caused to turn round its axis, namely the axis T—T. The power transmission mechanism for embodying this feature will now be described by reference to FIGS. 3 and 7.

An upright shaft 27 is rotated by a calender bottom shaft (not shown) through a gear mechanism (not shown), and first and second drive gears 28 and 29 are attached to the top end portion of the upright shaft 27. The first drive gear 28 is engaged with an intermediate gear 30 which is engaged with the outer teeth 5*a* of the annular gear 5. First to third intermediate gears 31 to 33 are interposed between the second drive gear 29 and the gear 2*a* of the rotary disc 2.

A first planetary gear 34 is supported on the inside of the rotary disc 2 by way of a bracket 50 so that its position can be adjusted, and this first planetary gear 34 is engaged with the inner teeth 5*b* of the annular gear 5. A bevel gear 35 is attached to a shaft 36 rotatably supported on the supporting bracket 24, as illustrated in FIG. 1. A third planetary gear 37 is attached to the lower end of the shaft 36. A second planetary gear 38 is disposed on the bracket 50 between the first and third planetary gears 34 and 37, so that the second planetary gear 38 is engaged with both the gears 34 and 37. A driven bevel gear 39, attached to the shaft 26 of the calender roller 25, is engaged with the bevel gear 35, and a pair of gears 40 and 41 engaged with each other are rigidly mounted on a pair of the shafts 26, respectively.

A fourth planetary gear 42 is rotatably supported on the supporting bracket 24 through a shaft 43 and is engaged with the second planetary gear 38. A fifth planetary gear 44 is fixed to the lower end of the shaft 43 and is engaged with the gear 23 attached to the connecting member 19.

As illustrated in FIG. 1, a stationary cover 45 is disposed on the frame 1, and a movable cover 46 is mounted on the upper portion of the connecting member 19 and a trumpet 47 is held on the movable cover 46.

The operation of the planetary coiler having the above-mentioned structure will now be described.

When the operation of the spinning machine is started and the upright shaft 27 is rotated, the rotary disc 2 is rotated through the second drive gear 29 and the first to third intermediate gears 31 to 33. With rotation of the rotary disc 2, the sliding supporting member 9, connecting members 17 and 19, coiler plate 16 and turn plate 21 are integrally rotated in the counterclockwise direction in FIG. 7 with the axis K—K as the center of rotation. The rotation of the shaft 27 is transmitted to the annular gear 5 through the first drive gear 28 and intermediate gear 30. The first planetary gear 34 is rotated by the annular gear **5*b* and the bevel gear 35 is in turn rotated by the planetary gear 34 through the second and third planetary gears 38 and 37. Further, by rotation of the bevel gear 35, the calender rollers 25 are rotated through the bevel gear 39, gears 40 and 41 and shafts 26. Simultaneously, the rotation of the second planetary gear 38 is transmitted to the gear 23 through the fourth and fifth planetary gears 42 and 44, to rotate the turn plate 21 through the connecting member 19 in the counterclockwise direction in FIG. 7, with the axis T—T as the center of rotation. Accordingly, the turn plate 21 is caused to revolve round the axis K—K while turning on the axis T—T, whereby sliver fed out below the coiler plate 16 through the trumpet 47, calender roller 25 and silver guide tube 22** is deposited in a can C while being coiled.

Figure 8:
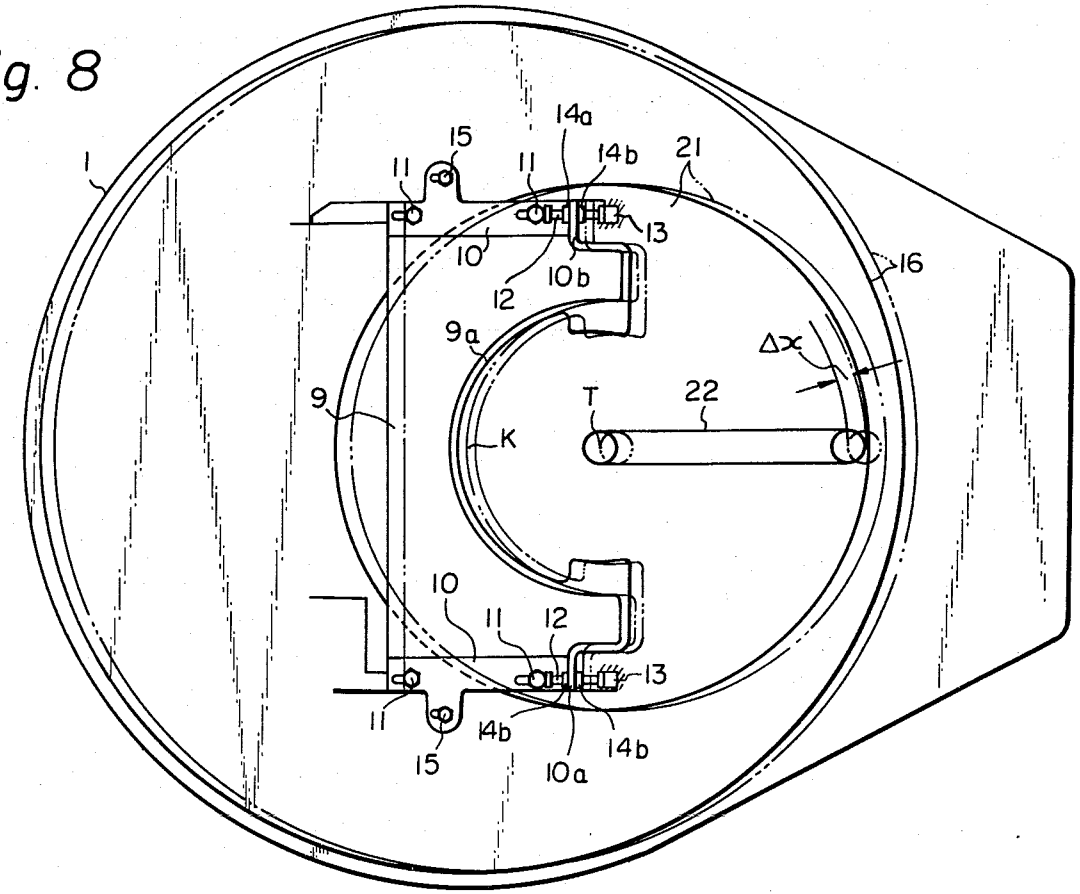
FIG. 8 is a plan view illustrating the eccentric state of the coiler plate and turn plate in the device illustrated in FIG. 1.

When the magnitude of eccentricity of the rotation axis T—T of the turn plate 21 to the rotation axis K—K of the rotary disc 2 is adjusted according to changes, in the size of the can C and spinning conditions, the movable cover 46 is removed and the nut **14*a* (or 14*b*) on the adjust bolt 12 and the bolt 15 are loosened, and then, the other nut 14*b* (or 14*a* ) is turned to move the sliding supporting member 9 to the right (or left) in FIG. 8. When adjustment, as illustrated in FIG. 8, is carried out, the outer diameter of the mass of the upper-most deposited and coiled sliver is shifted from the position indicated by a solid line to the position indicated by an imaginary line in FIG. 8. In short, the outer diameter of the upper-most sliver coil is changed by $\Delta x$. When a desired magnitude of eccentricity is obtained, the nuts 14*a* and 14*b* and the bolt 15 are clamped, and the first planetary gear 34 is placed in such a position that it can be engaged with both the inner teeth 5*b* of the annular gear 5 and the second planetary gear 38. Then, the first planetary gear 34 is clamped again onto the rotary disc 2** at this position.

As will be apparent from the above explanation, in the above described embodiment of the apparatus of the present invention, the sliding supporting member 9 is attached to the rotary disc 2 so that its position can be adjusted, the coiler plate 16 is attached to this sliding supporting member 9 through the connecting member 17, and also, the turn plate 21 is rotatably attached to this sliding supporting member 9 through the connecting member 19. By virtue of this characteristic arrangement, the coiler plate 16 does not have any contact line other than the contact line with the turn plate 21, and therefore, coiling of sliver can be accomplished in good condition while preventing the catching of sliver by any machine part.

Since the apparatus of the above mentioned embodiment is different from the conventional apparatus in the point that the rotary disc is not located on the peripheral portion of the coiler plate 16, the diameter of the stationary frame 1 can be reduced by a length corresponding to the rotary disc and therefore, the apparatus can be made compact and the structure can be simplified from that of the prior art.

Further, the coiler plate 16 and turn plate 21 are disposed in the inside portion of the rotary disc 2, so that the eccentric positions thereof can be adjusted by the sliding supporting member 9. Accordingly, adjustment can be performed very easily removing the movable cover 46 and adjusting the nuts **14*a* and 14*b*. Therefore, the eccentricity of either the coiler plate 16 or the turn plate 21** can be adjusted very easily. In the conventional apparatus of the type where a sliding plate (coiler plate) is slidably attached directly to the rotary disc, if an adjust bolt is attached to the inside of the sliding member, even when a cover is removed, the adjust bolt cannot be turned because of interference with other members. Accordingly, in the conventional apparatus, the adjust bolt is attached to the lower face of the contact portion between the rotary disc and sliding plate and the adjust bolt must be externally operated. Further, the presence of this adjust bolt is an obstacle to the coiling operation. This problem involved in the conventional apparatus can be solved by the apparatus of the present invention, as can be understood from the above-mentioned explanation.

In the above mentioned embodiment of the apparatus of the present invention, since the rotary disc 2 is supported on the top surface **1*a* of the stationary frame 1 through the thrust bearing 3, the coiler plate 16, the turn plate 21 and other members can be stably supported on the rotary disc 2**. Accordingly, no compulsive force is imposed on the mechanism and the apparatus can be operated very smoothly.

Furthermore, in the above mentioned embodiment of the apparatus of the present invention, the annular gear 5 is supported on the top surface **2*c* of the rotary disc 2 by the vertical roller 6, the horizontal roller 7 of the annular gear 5 is arranged to have rolling contact with the inner circumferential face 2*d* of the rotary disc 2, and the rotation axis of the annular gear is caused to be in agreement with the rotation axis K—K of the rotary disc 2. By virtue of this characteristic arrangement, centering of the annular gear 5 with respect to the rotary disc 2** can be accomplished very precisely, and smooth operation of the apparatus can be assured.

In the present invention, since it is not necessary to use an additional stationary frame for supporting the annular gear 5, the structure of the apparatus can be simplified over that of the prior art and the apparatus can be made compact. Accordingly, the manufacturing of the apparatus can be remarkably facilitated.

In order to attain precise centering of the annular gear 5 to the rotary disc 2, a high manufacturing precision is required for the inner circumferential surface *2d* of the rotary disc 2. This can be easily accomplished by machine tools now available.

In the above described embodiment, in order to attain centering between the rotary disc 2 and the annular gear 5, the horizontal roller 7 of the annular gear 5 is arranged to be in rolling contact with the inner circumferential face *2d* of the rotary disc. This centering can also be attained by an arrangement in which a peripheral face is formed on the annular gear 5 and a horizontal roller is disposed on the rotary disc 2, so that it is in rolling contact with the peripheral face of the annular gear, although this arrangement is not specifically illustrated in the drawings.

As will be apparent from the above explanation, the apparatus of the present invention comprises a stationary frame, a rotary disc mounted on the stationary frame, a sliding supporting member slidably mounted on the rotary disc to support a turn plate provided with a silver guide tube and a calender roll, a coiler plate fixed to the sliding supporting member to cover the peripheral edge of the lower side of the stationary frame, an annular gear having inner and outer teeth and being mounted on the rotary disc, a planetary gear engaged with the inner teeth of the annular gear and with a gear of the turn plate, transmission means for transmitting rotation of the annular gear to the calender roller, and drive means for rotating the rotary disc and annular gear, wherein the rotary disc is supported on the stationary frame through a thrust bearing, the coiler plate is supported on the sliding supporting member, the annular gear is supported rotatably with respect to the top surface of the rotary disc, and the inner and outer teeth of the annular gear are centered with respect to the rotary disc. By virtue of the above mentioned characteristic feature, in the apparatus of the present invention, no contact line other than the contact line with the turn plate is present in the coiler plate, and catching of silver or intrusion of fibers into contact line gaps can be prevented.

Further, in the apparatus of the present invention, since heavy machine elements, such as the coiler plate and turn plate, can be stably mounted on the rotary disc, the apparatus can be operated smoothly and centering of the annular gear with respect to the rotary disc can be performed very precisely. Moreover the structure can be simplified over that of the prior art and the apparatus can be made compact. These are effects and advantages attained by the present invention.

What we claim is:

1. A planetary coiler comprising a stationary frame, a rotary disc rotatably mounted on said stationary frame, a sliding supporting member slidably mounted on said rotary disc, a coiler plate rigidly supported by said sliding supporting member at a position slightly below the bottom peripheral edge of said stationary frame, said coiler plate provided with a circular aperture with an eccentric center located away from the center of said coiler plate, a supporting element rotatably mounted on said sliding supporting member at a position below said sliding supporting member, a turn plate rigidly mounted on said supporting element at a position slidably engaging in said circular aperture of said coiler plate, a pair of calender rollers rotatably mounted on said sliding supporting member, said turn plate being provided with a silver guide tube, an annular gear having inner and outer teeth and being mounted on said rotary disc, planetary gear drive means engaged with said inner teeth of said annular gear and with a gear of said turn plate, transmission means for transmitting rotation of said annular gear to said calender roller, and drive means for rotating said rotary disc and annular gear.

2. A planetary coiler according to claim 1, further comprising a plurality of horizontal rollers rotatably mounted on said stationary frame at respective positions where they are capable of contacting with a circular peripheral edge of said rotary disc so that the center of revolution of said rotary disc is fixed.

3. A planetary coiler according to claim 1, wherein said rotary disc is mounted on said stationary frame by means of a thrust bearing.

4. A planetary coiler according to claim 1, wherein said sliding supporting member is supported on a pair of parallel sliding surfaces formed on the inside of said rotary disc through attachment vanes so that a linear reciprocative movement of said supporting member can be created, and said sliding supporting member is adjustably disposed at an adjustable position thereof.

5. A planetary coiler according to claim 1 wherein said rotary disc is supported on the stationary frame through a thrust bearing, said annular gear is supported rotatably with respect to the top surface of said rotary disc, and said inner and outer teeth of said annular gear are centered with respect to said rotary disc.

6. A planetary coiler according to claim 1, wherein said annular gear is supported above said rotary disc by a plurality of vertical rollers and said annular gear is centered with respect to said inner circumferential surface of said rotary disc through a plurality of horizontal rollers.

* * * * *

UNITED STATES PATENT AND TRADEMARK OFFICE

CERTIFICATE OF CORRECTION

PATENT NO. : 4,236,279

DATED : Dec. 2, 1980

INVENTOR(S) : Kouichi Kawaura

It is certified that error appears in the above—identified patent and that said Letters Patent is hereby corrected as shown below:

Column 2, line 4: Cancel "heavy" and insert, in place thereof, --since--.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*